US007044225B2

(12) United States Patent
Haney et al.

(10) Patent No.: US 7,044,225 B2
(45) Date of Patent: May 16, 2006

(54) SHAPED CHARGE

(76) Inventors: Joseph Haney, 5983 N. Valley St., Dalton Gardens, ID (US) 83815; David Wesson, 6366 Elm Crest Ct., Fort Worth, TX (US) 76132

( * ) Notice: Subject to any disclaimer, the term of this patent is extended or adjusted under 35 U.S.C. 154(b) by 158 days.

(21) Appl. No.: 10/663,557

(22) Filed: Sep. 16, 2003

(65) Prior Publication Data

US 2005/0056459 A1 Mar. 17, 2005

(51) Int. Cl.
*E21B 43/263* (2006.01)

(52) U.S. Cl. ..... 166/308.1; 166/55.2; 166/63; 166/299

(58) Field of Classification Search ..... 166/55, 166/55.2, 63, 297–299, 308.1
See application file for complete search history.

(56) References Cited

U.S. PATENT DOCUMENTS

| | | | | |
|---|---|---|---|---|
| 4,633,951 | A | 1/1987 | Hill et al. | |
| 4,683,943 | A | 8/1987 | Hill et al. | |
| 4,823,875 | A | 4/1989 | Hill | |
| 4,955,939 | A | 9/1990 | Petrousky et al. | |
| 5,479,860 | A | 1/1996 | Ellis | |
| 5,551,346 | A | 9/1996 | Walters et al. | |
| 5,663,523 | A | 9/1997 | Williams | |
| 5,775,426 | A | 7/1998 | Snider et al. | |
| 5,859,383 | A | 1/1999 | Davison et al. | |
| 6,223,656 | B1 | 5/2001 | Glenn | |
| 6,446,558 | B1 | 9/2002 | Peker et al. | |
| 6,508,177 | B1 | 1/2003 | Badger et al. | |
| 6,520,258 | B1 | 2/2003 | Yang et al. | |
| 6,524,706 | B1 | 2/2003 | Manning et al. | |
| 6,554,081 | B1 | 4/2003 | Brooks et al. | |
| 2003/0037692 | A1 | 2/2003 | Liu | |
| 2003/0183113 | A1 * | 10/2003 | Barlow et al. | 102/476 |
| 2004/0050466 | A1 * | 3/2004 | Kneisl | 149/19.3 |

OTHER PUBLICATIONS

Patrick Brousseau, Helen Dorsett, Matthew Cliff, C. John Anderson. "Detonation Properties of Explosives Containing Nanometric Aluminum Powder." 2002 Deonation Symposium. San Diego, CA.

* cited by examiner

*Primary Examiner*—Zakiya W. Bates
(74) *Attorney, Agent, or Firm*—David W. Carstens; Carstens & Cahoon, LLP

(57) ABSTRACT

A shaped charge is formed having a pressed polymer pellet positioned between the explosive charge and the metal liner. The shock wave resulting from detonation of the explosive passes through the polymer to the liner. The collapse of the liner results in the formations of a jet—piercing the casing. The high-pressure gaseous by-products of the explosive force (inject) the polymer in the perforation "tunnel". This shockwave will also start the decomposition of the polymer. The polymer will continue to decompose during its injection into the tunnel. As it is being injected into the perforation tunnel, the residue heat generated by the explosive combined with the shear and induced plastic flow, the polymer will ignite and burn. The burn time will be an order of magnitude greater than the explosive; the pressure generated by the polymer will be an order of magnitude less than the explosive.

29 Claims, 8 Drawing Sheets

SHAPED CHARGE

TECHNICAL FIELD

The present invention relates to an improved shaped charge for use in fracturing a subterranean structure. Specifically, the shaped charge has a layer of polymer, metal—polymer, or metal/metal oxide—polymer mixture positioned between the charge liner and main explosive load or between the charge case and the main explosive load. As a result of the detonation of the explosive, the polymer or polymer mixture undergoes a shock-induced reaction resulting in the decomposition of the polymer and subsequent ignition and deflagration. The burn rate of this shock synthesized energetic material is an order of magnitude slower than the main explosive load.

BACKGROUND OF THE INVENTION

A shaped charge is an explosive device in which a metal shell called a liner, often conical or hemispherical, is surrounded by a high explosive charge, enclosed in a steel case. When the explosive is detonated, the liner is ejected as a very high velocity jet that has great penetrative power. The study of penetration by a shaped charge jet is of great importance, in respect of both military and civil applications. The latter include the oil industry, ejector seat mechanisms, and also civil engineering work such as the decommissioning of large structures.

Early work on shaped charges showed that a range of alternative constructions, including modifying the angle of the liner or varying its thickness, would result in a faster and longer metal jet. These research and development efforts to maximize penetration capabilities were based largely on trial and error. It was not until the 1970s that modeling codes could predict with any accuracy how a shaped charge would behave. While the concept of a metal surface being squeezed forward may seem relatively straightforward, the physics of shaped charges is very complex and even today is not completely understood.

One field that has benefited greatly from the use of shaped charges is the production of oil and gas. Oil and gas is located in subterranean formations. These formations have a permeability that dictates the rate at which the oil or gas can flow through the formation. To improve this permeability, the formation can be fractured.

Before fracturing occurs, a well is bored into the formation. Individual lengths of relatively large diameter metal tubulars are secured together to form a casing string that is positioned within a subterranean well bore to increase the integrity of the well bore and provide a path for producing fluids from the formation to the surface. Conventionally, the casing is cemented to the well bore face and subsequently perforated by detonating shaped explosive charges. These perforations extend through the casing and cement a short distance into the formation. In certain instances, it is desirable to conduct such perforating operations with the pressure in the well being overbalanced with respect to the formation pressure. Under overbalanced conditions, the well pressure exceeds the pressure at which the formation will fracture, and therefore, hydraulic fracturing occurs in the vicinity of the perforations. As an example, the perforations may penetrate several inches into the formation, and the fracture network may extend several feet into the formation. Thus, an enlarged conduit can be created for fluid flow between the formation and the well, and well productivity may be significantly increased by deliberately inducing fractures at the perforations.

When the perforating process is complete, the pressure within the well is allowed to decrease to the desired operating pressure for fluid production. As the pressure decreases, the newly created fractures tend to close under the overburden pressure. To ensure that fractures and perforations remain open conduits for fluids flowing from the formation into to the well or from the well into the formation, particulate material or proppants are conventionally injected into the perforations so as to prop the fractures open. In addition, the particulate material or proppant may scour the surface of the perforations and/or the fractures, thereby enlarging the conduits created for enhanced fluid flow. The proppant can be emplaced either simultaneously with formation of the perforations or at a later time by any of a variety of methods.

As the high-pressure pumps necessary to achieve an overbalanced condition in a well bore are relatively expensive and time consuming to operate, propellants have been utilized in conjunction with perforating techniques as a less expensive alternative to hydraulic fracturing. Shaped explosive charges are detonated to form perforations that extend through the casing and into the subterranean formation and a propellant is ignited. The gas generated by the burning (deflagration) of the propellant pressurizes the perforated subterranean interval and initiates and propagates fractures therein.

U.S. Pat. Nos. 4,633,951, 4,683,943 and 4,823,875 to Hill et al. describe a method of fracturing subterranean oil and gas producing formations wherein one or more gas generating and perforating devices are positioned at a selected depth in a wellbore by means of a wireline that may also be a consumable electrical signal transmitting cable or an ignition cord type fuse. The gas generating and perforating device is comprised of a plurality of generator sections. The center section includes a plurality of axially spaced and radially directed perforating shaped charges that are interconnected by a fast burning fuse. Each gas generator section includes a cylindrical thin walled outer canister member. Each gas generator section is provided with a substantially solid mass of gas generating propellant which may include, if necessary, a fast burn ring disposed adjacent to the canister member and a relatively slow burn core portion within the confines of ring. An elongated bore is also provided through which the wireline, electrical conductor wire or fuse that leads to the center or perforating charge section may be extended. Detonating cord fuses or similar igniters are disposed near the circumference of the canister members. Each gas generator section is simultaneously ignited to generate combustion gasses and perforate the well casing. The casing is perforated to form apertures while generation of gas commences virtually simultaneously. Detonation of the perforating shaped charges occurs at approximately 110 milliseconds after ignition of gas generating unit and that from a period of about 110 milliseconds to 200 milliseconds a substantial portion of the total flow through the perforations is gas generated by gas generating unit. None of these devices made use of a propellant to increase the effectiveness of the shaped charge.

U.S. Pat. No. 5,775,426 to Snider et al. provides one example of an improved shaped charge that uses a propellant. FIG. 1 illustrates the concept behind the Snider et al. apparatus 100. The shaped charge is located in case 110. It is mounted in a cylindrical carrier 122. A propellant sleeve 120 is located around the carrier. Propellant sleeve 120 may be cut from a length of propellant tubular and positioned around perforating charge carrier 122 at the well site. The apparatus 100 is then located in the well with the perforating charges adjacent the formation interval to be perforated. The perforating charges 110 are then detonated. Upon detonation, each perforating charge 110 blasts through a scallop 124 in carrier 122, penetrates propellant sleeve 120, creates an opening in casing 102 and penetrates formation forming perforations therein. Propellant sleeve 120 breaks apart and ignites due to the shock, heat, and pressure of the detonated shaped charge 110. When one or more perforating charges penetrate the formation, pressurized gas generated from the burning of propellant sleeve 120 enters formation 104 through the recently formed perforations thereby cleaning such perforations of debris. These propellant gases also stimulate formation 104 by extending the connectivity of formation 104 with the well by means of the pressure of the propellant gases fracturing the formation.

A standard perforating shaped charge 110 is shown in FIG. 1B. It includes a charge case 112, typically steel or zinc, a booster 114, and an explosive 116 also known as the main load, along with a metal liner 118.

One drawback of the Snider et al. device is that it requires a substantial volume of well fluid to be placed above the device prior to ignition. This fluid provides the initial hydrostatic pressure required to facilitate the desired propellant burn rate after ignition. In other words, the burn rate is proportional to the hydrostatic pressure. The fluid also enables temporary confinement of the gas pressure generated by burning of the propellant. Basically, the well fluid prevents the combustion gas from escaping up the well bore, resulting in the build-up of the gas pressures required to fracture the formation rock. However, this also means that a great deal of the energy created by the propellant is lost on the well fluid instead of the formation. The efficiency of the Snider et al. device is directly controlled by the amount and type of well fluid.

FIG. 2 provides an illustration of another shaped charge as disclosed in published U.S. Patent Application No. 2003/0037692 to Liu. In one embodiment 200 of the Liu device, he uses a liner having two layers, a high-density airside layer 202 and a low-density explosive side layer 204. Layer 202 can be made of high-density compositions like iron, tin, copper, tungsten, lead etc., in solid alloy or in compacted powder form, as is used in conventional deep penetration shaped charges. The explosive-side layer 204 can be made of solid aluminum or compacted aluminum powder. The explosive 206 is a mixture of high explosive and aluminum (HE/Al) with surplus aluminum (Al) in stoichiometry. The charge penetrates the target and releases a substantial amount of Al in molten state, inducing an Al—$H_2O$ reaction in water. Thus, Liu uses aluminum in both the explosive and as a propellant layer. And while the aluminum is effective in the presence of water, this technique fails if the aluminum is too cool (below 660° C.) or if there is insufficient quantities of water in the formation or in the gaseous, explosive combustion by-products. Also, the burn rate of the aluminum is not as variable and controllable as needed to fracture various types of rocks under varying over-burden stress conditions.

Despite the advances of Snider and Liu, a need still exists for a shaped charge that combines the variable burn rate and long burn time of the Snider device with Liu's combination shaped charge that both penetrates and fractures the rock.

SUMMARY OF THE INVENTION

The present invention overcomes many of the disadvantages of the Snider invention and others by using a polymer/polymer mixture in conjunction with the main explosive load of a shaped charge to effectively perforate and stimulate (fracture) oil and gas wells. Polymers, specifically fluorinated polymers such as polytetrafluoroethylene, are generally considered as inert and non-flammable. However, they can undergo molecular decomposition into both gaseous and non-gaseous products as a result of shockwave induced dissociation. The decomposition products can be highly reactive and energetic. These decomposition products in themselves or when combined with metals, metal oxides, and or oxidizers can react as an energetic material (propellant) with a burn rate that is an order of magnitude slower than the main explosive load. In this application, the term "polymer" is defined broadly. It can include polymers, monomers, co-polymers and ligamers. The term is unrestricted by molecular weight. Further, the polymer could be in a liquid state or a solid state or a combination of the two states. The term polymer mixture includes a polymer and a metal or a metal and metal oxide combination. The term polymer/polymer mixture shall mean any combination thereof.

In one embodiment, a shaped charge is formed having a pressed layer of polymer or polymer mixture positioned between the explosive charge and the metal liner. The shock wave resulting from detonation of the explosive passes through this layer before impacting the liner. The collapse of the liner results in the formations of a jet—piercing the casing. This shock wave also results in the initial decomposition of the polymer. The high-pressure gaseous by-products of the explosion force (inject) the decomposed polymer or polymer mixture into the perforation "tunnel". This synthesized material continues to undergo substantial shearing and plastic deformation during this process. The heat of combustion of the explosive, combined with shock-induced decomposition of the polymer and the increase in chemical reactivity due to shear results in the formation of energetic materials capable of releasing considerable heat and gas. The polymer or polymer mixture and decomposition products will continue to burn during and after its injection into the tunnel. Any residue material in the slug or tail of the jet will also continue to burn and produce heat and gas—but at a lower burn rate. The burn time of the synthesized propellant will be an order of magnitude greater than the explosive; the pressure generated by the propellant will be an order of magnitude less than the explosive. To effectively stimulate (fracture) the rock around the perforation tunnel—a pressure pulse of a minimum of 1 to 2 milliseconds duration with a peak pressure of approximately 15–25,000 psi is typically necessary. There are multiple embodiments utilizing various polymers, metal—polymer, and metal/metal oxide—polymer mixtures. Varying the specific mixture components, as well as the thickness and density of layer can be used to control the burn rate of the material and amount of gas generated.

Multiple types of polymers and co-polymers can be used, for example polytetrafluoroethylene (Teflont™) has substantial energetic properties when exposed to shock and shear. The amount of available energy can be increased by adding metals, such aluminum or titanium, or metal/metal oxides, such as Thermite ($Fe_2O_3$+2 Al). Polytetrafluoroethylene enables both shock-induced reactions (ultra fast reactions driven by the shock wave induced shear) and shock—assisted chemical reactions (thermally controlled—mass diffusion reactions). These properties of polytetrafluoroethylene or a polytetrafluoroethylene mixture enable the controllability required to determine when the energetic material is ignited, for how long it will burn, and at what pressure. There are also numerous additives, such as glass micro spheres, which can be used to control the polymer or polymer mixture's exact ignition mechanism and timing. The metal used in the liner could be used to control and/or enhance the reaction with polytetrafluoroethylene. Aluminum has been used as a liner material for many years. The reaction of aluminum in the jet "slug" with the polytetrafluoroethylene layer could release considerable energy—without having to add additional Al to the polymer mixture.

This embodiment of the new shaped charge is a substantially more efficient approach as compared to the Snider et al. device described above. By "injecting" the energetic material into the perforation tunnel, essentially all the generated pressure is used to fracture the rock. The new system also requires less auxiliary equipment, and has less operating restrictions. The new feature is the concept using an essentially inert polymer, such as polytetrafluoroethylene—as a shock-induced gas generator. Unlike Liu's shape charge, water from the formation or from combustion by-products is not required. Also, the required reaction temperature's are much less (polytetrafluoroethylene decomposes at 555° C., and at <500° C. when exposed to shock or dynamic compression (impact), or when mixed with fine metals). In another embodiment, a layer of polymer/polymer mixture is placed between the charge case and the main explosive load. As in the previous embodiment, the polymer/polymer mixture undergoes a shock/shear induced synthesis into an energetic material. This material ignites and deflagrates. The pressures generated by the combustion gases from the explosive and the polymer/polymer mixture result in the fracturing of the rock.

BRIEF DESCRIPTION OF THE DRAWINGS

The novel features believed characteristic of the invention are set forth in the appended claims. The invention itself, however, as well as a preferred mode of use, further objects and advantages thereof, will best be understood by reference to the following detailed description of an illustrative embodiment when read in conjunction with the accompanying drawings, wherein:

DETAILED DESCRIPTION OF THE DRAWINGS

Figure 1A:
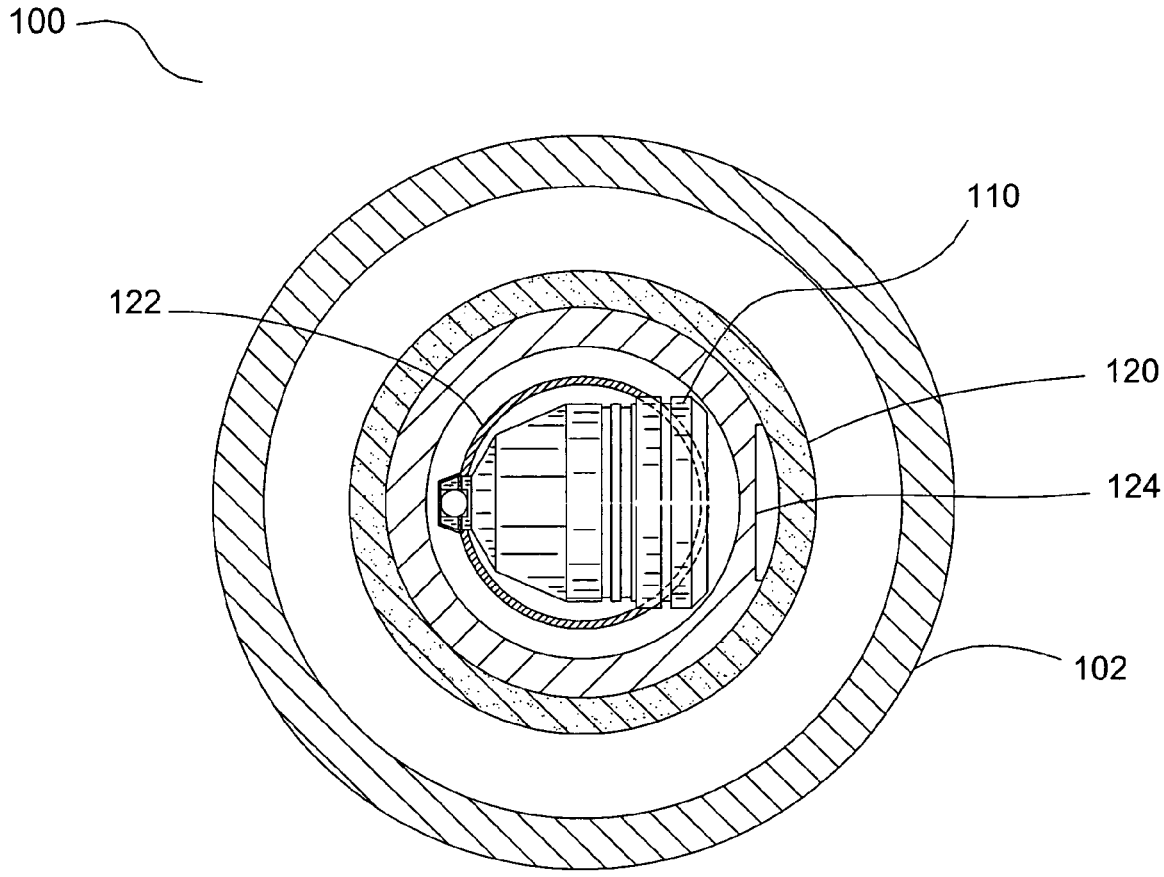
FIG. 1A (PRIOR ART)
FIG. 1A provides a top sectional view of a prior art device showing a propellant sleeve around the charge carrier.
Figure 1B:
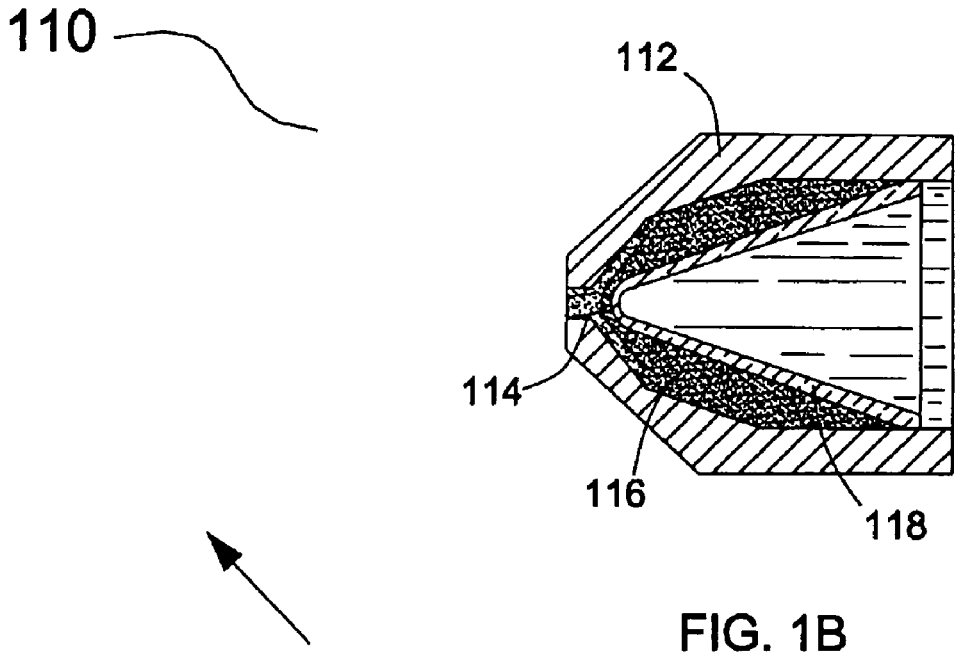
FIG. 1B (PRIOR ART)
FIG. 1B is a sectional view of a standard shape charge.
Figure 2:
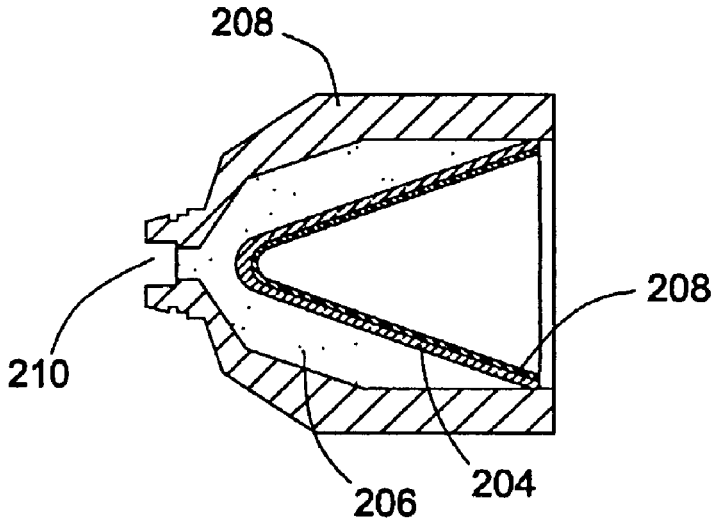
FIG. 2 (PRIOR ART)
FIG. 2 is another prior art device showing a multi-layer liner.
Figure 3:
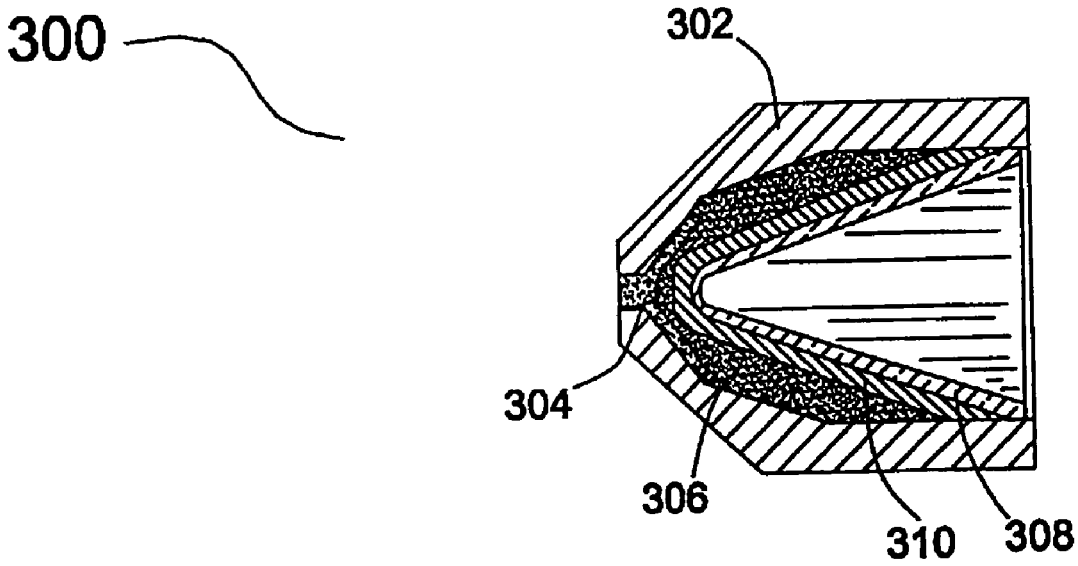
FIG. 3 is a sectional view across a shaped charge that embodies the present invention.

FIG. 3 provides an exemplary view of the present invention. A shaped charge 300 is shown having an outer case 302. The charge case, usually made of steel, is generally conical in shape. Further, its outer dimensions are suited for mounting in a commercially common charge carrier. A booster 304 is ignited by a fuse or other primer cord. The booster 304 then ignites the main load 306 that substantially fills the inside surface of the casing 302. A liner 308 seals the explosives within the case. The main load 306 is typically HMX or RDX. Between the liner 308 and the main load 306 is the polymer/polymer mixture 310. The polymer/polymer mixture can be a polymer or polymer mixture. In a preferred embodiment, the polymer/polymer mixture is a mixture of polytetrafluoroethylene and titanium.

In another embodiment, a polymer propellant is used and the charge case is made out of a polymer mixture (such as 80% Ti+20% polytetrafluoroethylene). The shock wave from the detonation of the explosive will also detonate the charge case. The detonation of the charge case will temporarily confine the charge explosive combustion by-products. This will increase the amount of polymer/polymer mixture injected into the perforation tunnel. It should also increase the shape charge penetration and add additional gas available for fracturing the rock.

In another embodiment, a layer of a mixture of an oxidizer, such as potassium perchlorate, and a polymer is placed between the liner and the charge explosive. Unlike Liu's shaped charge, the polymer/polymer mixture, not a metal, is the fuel source. Another oxygen source could be ammonia perchlorate.

Figure 4A:
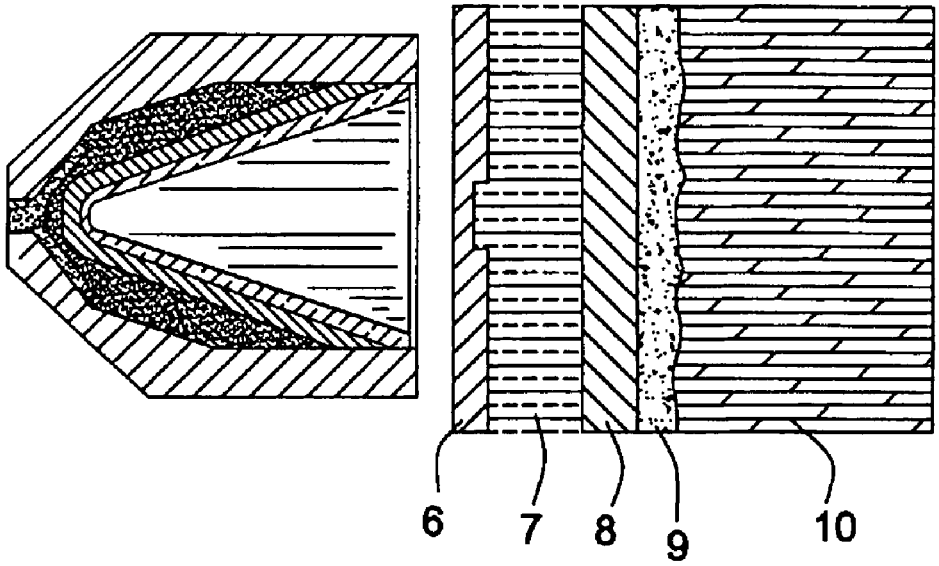
FIGS. 4A to 4F provide a sequenced view of the shaped charges' ignition and penetration followed by the additional fracturing from the slower burning propellant.
Figure 4:
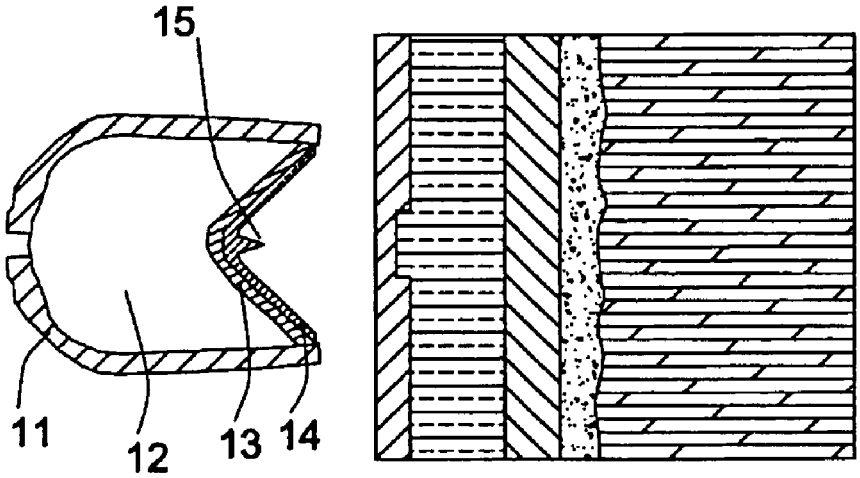

FIGS. 4A to 4F provide a sequenced view of the shaped charges' ignition and penetration followed by the additional fracturing from the slower decomposing polymer/polymer mixture. The sequence times given are only approximate. FIG. 4A shows the shaped charge 400 in its environment of usage. It is located in a well, adjacent to a formation 10 of interest. The perforating gun, or carrier, outer wall 6 is spaced several millimeters in front of the liner. Typically, the annulus between the carrier and the casing is filled with wellbore fluid 7. Next, the well casing 8 is shown fixed to the formation 10 by cement 9. At the beginning of the perforation sequence, t=0 microseconds (μs), the casing, liner, propellant and booster are intact.

FIG. 4B illustrates the state of the detonation at approximately 5 microseconds. The booster has detonated, forming a shock wave that have ignited the main load and started to deform the polymer/polymer mixture and the liner. The charge case is still intact. The explosive shock wave advances through the main load. When it reaches the liner apex, the liner collapses toward the axis of the liner. The initial jet is formed.

Figure 4C:
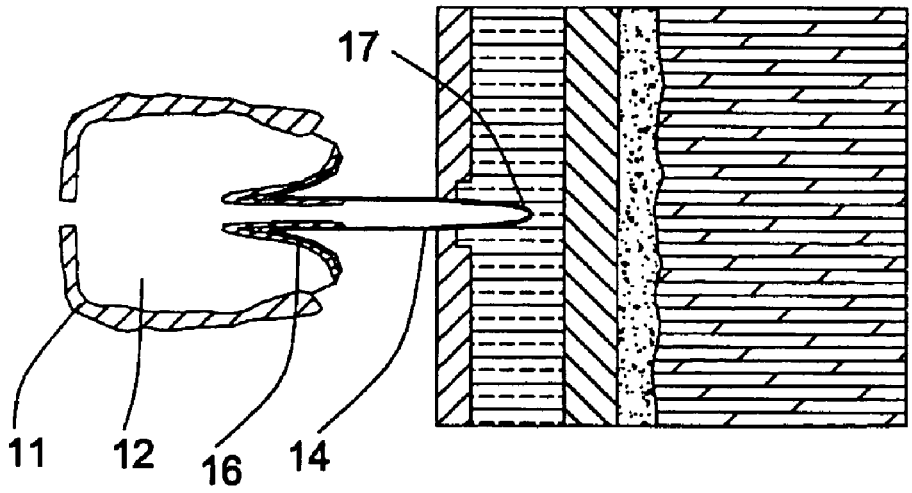

FIG. 4C illustrates the state of the detonation at approximately 20 microseconds. Because of its position—between the liner and the main load, a small amount of the polymer/polymer mixture is forced into the perforating tunnel following the high velocity jet. The charge case has deformed. The liner is continuing to collapse. The liner has started to separate into components—the high velocity jet and the lower velocity slug.

Figure 4D:
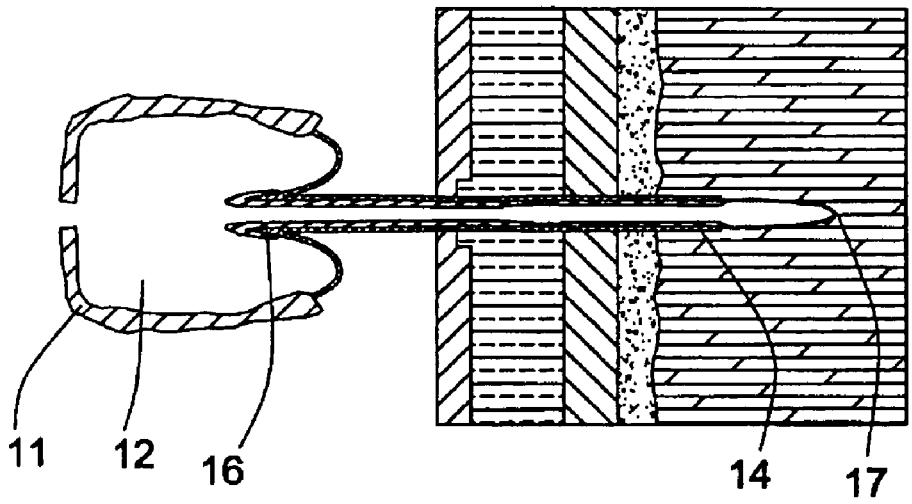
Figure 4E:
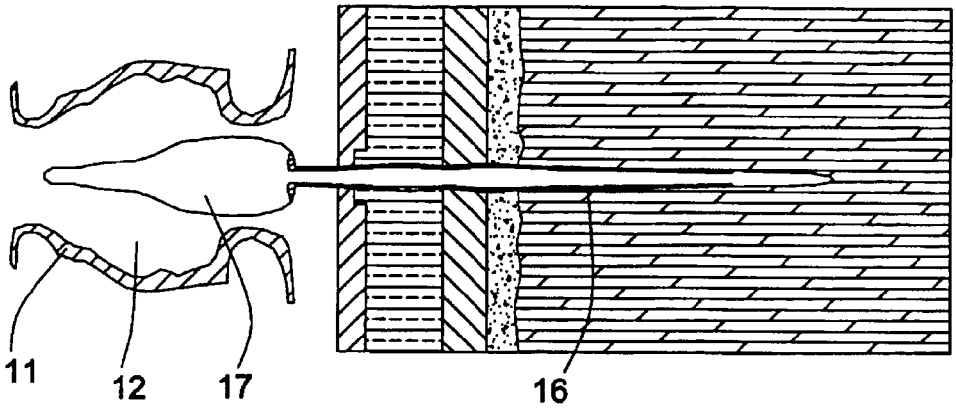

FIG. 4D illustrates the state of the detonation at approximately 50 microseconds. The liner completely collapses. The jet is completely formed, and is penetrating into the rock. However, its deformation is producing significant shear stress within the liner material. FIG. 4E illustrates the state of the detonation at around 200 microseconds. The jet velocity has decreased to a point where rock penetration ceases. However, the tail end of the high velocity jet, the slug, and the polymer/polymer mixture remains in motion. The polymer/polymer mixture begins to decompose around 1000 microseconds into the sequence due to the heat and/or shear it experiences. The decomposition of the polymer/ polymer mixture provides the necessary pressure for further fracturing of the formation. Depending on the mixture used, the polymer continues to burn for approximately 2 milliseconds. Peak pressure of approximately 15–25,000 psi is generated. The exact burn time and maximum pressure will be dependent on the specific polymer/polymer mixture used, as well as the amount and density of the material used, as well the and rock properties.

Figure 4F:
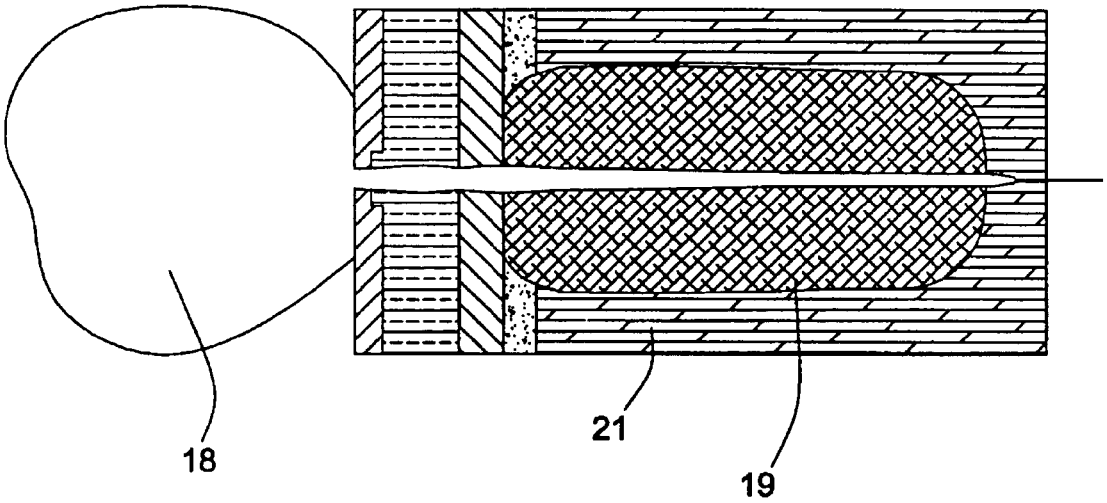

At 2000 microseconds, as shown in FIG. 4F, the rock is fractured by the gas pressure generated by the decomposition of the polymer. The polymer combustion gases combined with the residue explosive combustion gases flow into the fractures further propagating them. At 3000 microseconds, the polymer burn ceases. Fracturing in the rock continues until the pressure in fracture decreases below rock in-situ stress levels. The number and length of fractures will depend on amount of polymer and explosive used, charge design, liner type, charge case design and materials used, the volume of perforating gun and the number of charges.

Figure 5:
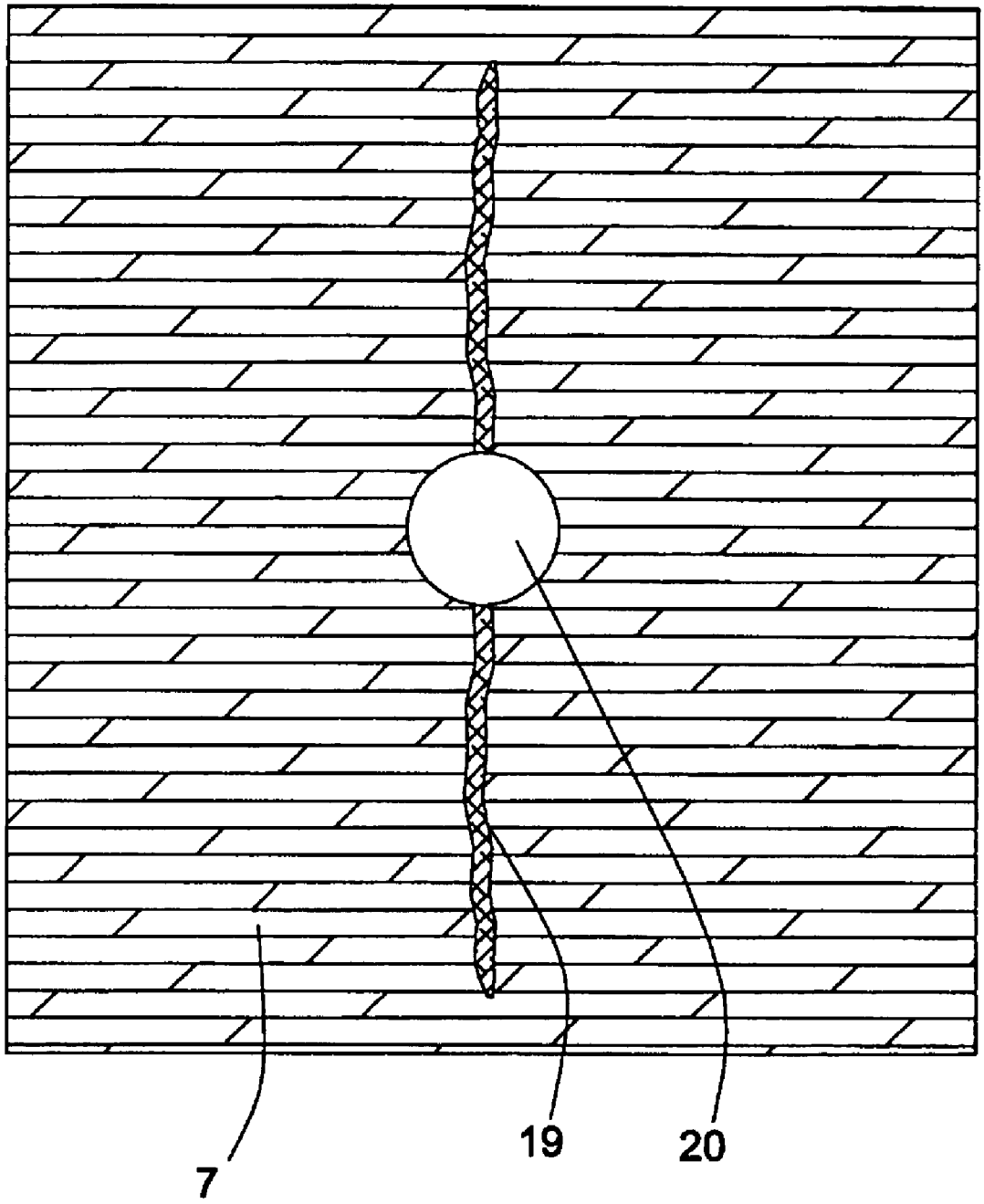
FIG. 5 provides a top view showing a fracturing pattern caused by the present invention.

FIG. 5 is a top view showing the general pattern of fracturing induced by the present invention. Note that it is a generally radial pattern that tapers inward with the distance from the shaped charge.

Figure 6A:
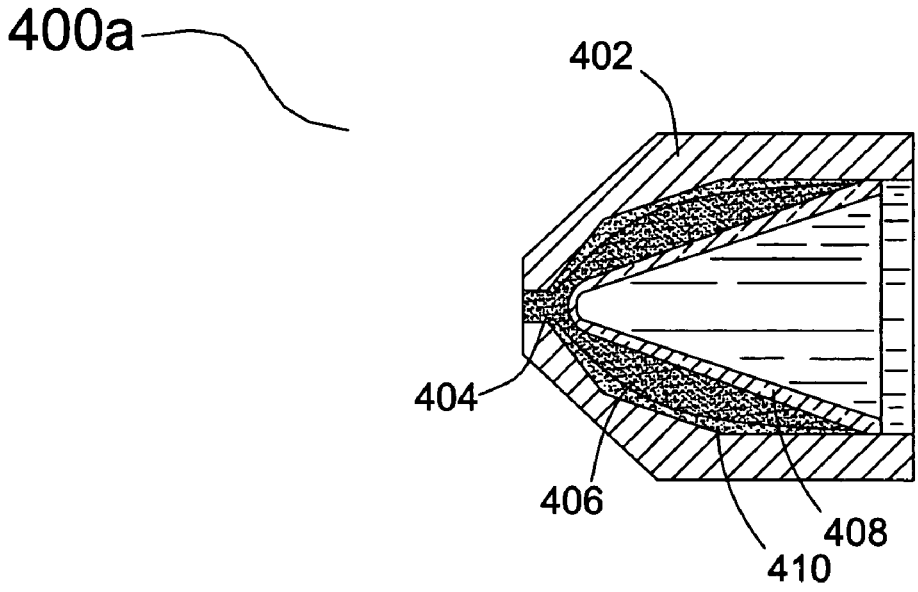
FIGS. 6A and 6B illustrate another embodiment wherein the polymer/polymer mixture is between the casing and the main load.
Figure 6B:
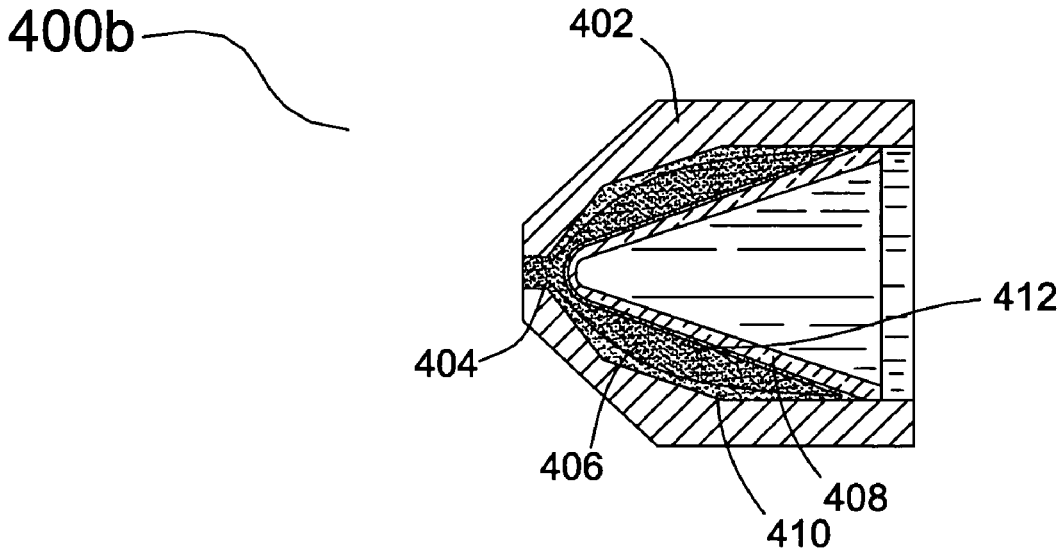

FIGS. 6A and 6B show additional configurations of the present invention. In FIG. 6A, the shaped charge 400*a* has an outer case 402. As before, the case 402 is generally conical in shape and is suited for mounting in a commercially common charge carrier. A booster 404 is ignited by a fuse or other primer cord. The booster 404 then ignites the main load 406 that substantially fills the inside surface of the casing 402. A liner 408 seals the explosives within the case. The main load 406 is typically HMX or RDX. However, in contrast to earlier embodiments, the polymer/polymer mixture 410 is between the case 402 and the main load 306. FIG. 6B shows a similar embodiment to FIG. 6A, with the exception that the polymer/polymer mixture 410 is on both surfaces of the main load 406.

It will be understood by one of ordinary skill in the art that numerous variations will be possible to the disclosed embodiments without going outside the scope of the invention as disclosed in the claims. For example, while a polymer/polymer mixture is used, it can be combined with a decomposition catalyst such as a rare earth compound or a strong acid. A rare earth compound might be Serium 4 oxide ($CeO2$). A strong acid could be a sulfuric acid, tiflic acid, or an ion exchange acid such as sulfonated styrene.

We claim:

1. An improved shaped charge comprising:

(a) a charge case, (b) a main load within the charge case; and (c) a layer of a polymer/polymer mixture positioned between the main load and a liner wherein the polymer/polymer mixture comprises a metal oxide.

2. The improved shaped charge of claim 1 further comprises:

(d) a booster coupling the main load to an ignition source.

3. The improved shaped charge of claim 1 wherein the polymer/polymer mixture undergoes a decomposition reaction to produce a fracturing pressure event.

4. The improved shaped charge of claim 1 wherein the polymer/polymer mixture further comprises a metal.

5. The improved shaped charge of claim 4 wherein the polymer/polymer mixture is polytetrafluoroethylene and aluminum.

6. The improved shaped charge of claim 4 wherein the polymer/polymer mixture is polytetrafluoroethylene and titanium.

7. The improved shaped charge of claim 1 wherein the polymer/polymer mixture comprises an additional oxygen source.

8. The improved shaped charge of claim 7 wherein the oxygen source comprises a perchlorate salt.

9. The improved shaped charge of claim 1 wherein the polymer/polymer mixture is polytetrafluoroethylene.

10. The improved shaped charge of claim 1 wherein the polymer/polymer mixture is mixed with an ignition speed controller.

11. The improved shaped charge of claim 1 wherein the polymer/polymer mixture is polytetrafluoroethylene and a metal/metal oxide mixture.

12. The improved shaped charge of claim 1 wherein the charge case comprises zinc.

13. The improved shaped charge of claim 1 wherein the charge case comprises steel.

14. The improved shaped charge of claim 1 wherein the charge case comprises a polymer and metal mixture.

15. The improved shaped charge of claim 1 wherein the charge case comprises a mixture of polytetrafluoroethylene and titanium.

16. The improved shaped charge of claim 1 further comprises:

(d) a decomposition catalyst.

17. An improved shaped charge comprising:

(a) a charge case, (b) a main load within the charge case;

(c) a layer of a polymer/polymer mixture positioned between the main load and a liner; and (d) a booster coupling the main load to an ignition source;

wherein the polymer/polymer mixture comprises a metal oxide, further wherein the polymer/polymer mixture undergoes a decomposition reaction to produce a fracturing pressure event.

18. The improved shaped charge of claim 17 wherein the polymer/polymer mixture further comprises a metal.

19. The improved shaped charge of claim 17 wherein the polymer/polymer mixture comprises an additional oxygen source.

20. The improved shaped charge of claim 19 wherein the oxygen source comprises a perchlorate salt.

21. The improved shaped charge of claim 17 wherein the polymer/polymer mixture further comprises polytetrafluoroethylene.

22. The improved shaped charge of claim 17 wherein the polymer/polymer mixture further comprises polytetrafluoroethylene and aluminum.

23. The improved shaped charge of claim 17 wherein the polymer/polymer mixture further comprises polytetrafluoroethylene and titanium.

24. The improved shaped charge of claim 17 wherein the polymer/polymer mixture is mixed with an ignition speed controller.

25. The improved shaped charge of claim 17 wherein the polymer/polymer mixture further comprises polytetrafluoroethylene and a metal/metal oxide mixture.

26. The improved shaped charge of claim 17 wherein the charge case comprises a polymer and metal mixture.

27. The improved shaped charge of claim 17 wherein the charge case comprises a mixture of polytetrafluoroethylene and titanium.

28. The improved shaped charge of claim 17 further comprises a decomposition catalyst.

29. A method of fracturing a formation comprising the steps of:

(a) lowering an improved shaped charge into a well to a depth adjacent to the formation; wherein the shaped charge has a charge case, a main load within the charge case; and a layer of a polymer/polymer mixture positioned between the main load and a liner wherein the polymer/polymer mixture comprises a metal oxide; and, (b) detonating the shaped charge.

* * * * *